US008186554B2

(12) United States Patent
Abla

(10) Patent No.: US 8,186,554 B2
(45) Date of Patent: May 29, 2012

(54) TAPERED GUIDE BUSHING FOR RECIPROCATING DRIVER AND TOOL INCORPORATING SAME

(75) Inventor: Keith Daniel Abla, Kalamazoo, MI (US)

(73) Assignee: Powernail Company, Lake Zurich, IL (US)

( * ) Notice: Subject to any disclaimer, the term of this patent is extended or adjusted under 35 U.S.C. 154(b) by 28 days.

(21) Appl. No.: 12/460,287

(22) Filed: Jul. 16, 2009

(65) Prior Publication Data

US 2010/0084451 A1 Apr. 8, 2010

Related U.S. Application Data

(60) Provisional application No. 61/081,062, filed on Jul. 16, 2008.

(51) Int. Cl.
*B25C 5/02* (2006.01)
*B25C 5/06* (2006.01)
*B25C 7/00* (2006.01)

(52) U.S. Cl. ..... 227/148; 227/156

(58) Field of Classification Search ..... 227/156, 227/107–155; 173/107–155
See application file for complete search history.

(56) References Cited

U.S. PATENT DOCUMENTS 1,922,614 A * 8/1933 Bradshaw ..... 30/358
2,472,353 A * 6/1949 Barth et al. ..... 227/147
2,671,216 A * 3/1954 Fox ..... 227/147
2,713,905 A * 7/1955 Hartley ..... 30/358
2,866,974 A * 1/1959 Hoffman ..... 227/113
3,041,614 A 7/1962 D'Haem et al.
3,589,586 A * 6/1971 Mazzer ..... 227/130
3,774,293 A * 11/1973 Golsch ..... 29/432.1
3,789,895 A 2/1974 Levinson
4,194,665 A 3/1980 Maestri
4,204,580 A * 5/1980 Nalley ..... 173/48
4,234,375 A * 11/1980 Ciccarello ..... 156/530
4,448,339 A * 5/1984 Pettigrew ..... 227/147
4,541,160 A * 9/1985 Roberts ..... 29/401.1
4,566,619 A * 1/1986 Kleinholz ..... 227/8
4,581,964 A * 4/1986 Takatsuru ..... 81/464
4,867,366 A * 9/1989 Kleinholz ..... 227/66

(Continued)

OTHER PUBLICATIONS

Central Pneumatic Air Mini Hand Nailer Model 90193. Assembly and Operating Instructions. Harbor Freight Tools. Date: 2003.

(Continued)

*Primary Examiner* — Rinaldi Rada
*Assistant Examiner* — Robert Long
(74) *Attorney, Agent, or Firm* — Jansson Shupe & Munger Ltd.

(57) ABSTRACT

A guide bushing for a reciprocating nailer includes a body having a cylindrical portion and a tapered portion. An aperture extends through the body for receiving a driving rod. The tapered portion of the guide bushing extends from the nailer and is configured to fit into tight spaces, such as corners and along the tongues or grooves of, for instance, tongue and groove flooring, to fully support a nail as it is driven into the tight space. The guide bushing can be a multiple part or multiple stage bushing for more flexibility and utility. The aperture through the center of the bushing can also be stepped to cooperate with a stepped driving rod for closer holding of narrower nails. A boot can be placed at the tip of the guide bushing to provide a cushion and further retention of a nail held by the nailer.

19 Claims, 9 Drawing Sheets

U.S. PATENT DOCUMENTS

| | | | | |
|---|---|---|---|---|
| 5,033,552 | A * | 7/1991 | Hu | 173/217 |
| 5,065,926 | A * | 11/1991 | Yerly | 225/93 |
| 5,163,596 | A | 11/1992 | Ravoo et al. | |
| 5,180,091 | A | 1/1993 | Ota | |
| 5,205,457 | A * | 4/1993 | Blomquist, Jr. | 227/66 |
| 5,320,268 | A * | 6/1994 | Shkolnikov et al. | 227/66 |
| 5,806,609 | A * | 9/1998 | Stock et al. | 173/205 |
| 5,810,239 | A * | 9/1998 | Stich | 227/119 |
| 6,036,073 | A * | 3/2000 | Newhouse | 227/147 |
| 6,286,742 | B1 * | 9/2001 | Mukoyama | 227/8 |
| 6,345,755 | B1 * | 2/2002 | Fields | 227/142 |
| 6,402,007 | B1 * | 6/2002 | Dyer | 227/147 |
| 6,443,348 | B2 | 9/2002 | Lamb | |
| 6,481,612 | B1 | 11/2002 | Mangone, Jr. | |
| 6,631,836 | B2 | 10/2003 | Dickhaut | |
| 6,805,272 | B1 * | 10/2004 | Sen-Mu et al. | 227/130 |
| 6,843,402 | B2 * | 1/2005 | Sims et al. | 227/148 |
| 6,942,134 | B2 * | 9/2005 | Naito | 227/51 |
| 7,237,621 | B2 * | 7/2007 | Hsieh | 173/104 |
| 7,255,256 | B2 * | 8/2007 | McGee et al. | 227/8 |
| 7,344,057 | B2 | 3/2008 | Dion et al. | |
| 7,374,377 | B2 * | 5/2008 | Bauman | 408/239 R |
| 7,721,627 | B2 * | 5/2010 | Basham et al. | 81/57.14 |
| 2003/0041704 | A1 * | 3/2003 | Pelt | 81/466 |
| 2005/0051596 | A1 * | 3/2005 | Estes | 227/139 |
| 2006/0196682 | A1 * | 9/2006 | McGee et al. | 173/1 |
| 2007/0012744 | A1 | 1/2007 | Losada | |
| 2007/0075112 | A1 | 4/2007 | Porth et al. | |
| 2007/0095875 | A1 | 5/2007 | Lamb | |
| 2007/0108250 | A1 | 5/2007 | Odoni et al. | |
| 2007/0199970 | A1 | 8/2007 | Chen | |
| 2007/0215668 | A1 | 9/2007 | Tabacco et al. | |
| 2008/0029567 | A1 | 2/2008 | Blessing et al. | |
| 2008/0099527 | A1 | 5/2008 | Ou | |
| 2008/0105724 | A1 | 5/2008 | Kim et al. | |
| 2008/0257932 | A1 | 10/2008 | Nagata | |
| 2008/0296339 | A1 | 12/2008 | Fielitz et al. | |
| 2008/0308597 | A1 | 12/2008 | Wojcicki | |
| 2009/0084567 | A1 * | 4/2009 | Basham et al. | 173/29 |
| 2009/0266867 | A1 * | 10/2009 | Mina et al. | 227/151 |
| 2010/0308098 | A1 * | 12/2010 | Francis et al. | 227/148 |

OTHER PUBLICATIONS

Grip Rite Operator's Manual and Parts List Model GRTMP16 Mini Air Nailer. Prime Source Building Products, Inc. Date: Unknown.

Grip Rite GRTMP16 Repair Kit of GRDAK1500—Driver Assembly Kit. Prime Source Building Products, Inc. Date: Unknown.

Operator's Manual Craftsman Palm Nailer Model No. 351.182930. Sears Roebuck & Co. Date: 2000.

PN2 Palm Nailer. <www.winlytools.com>. Winly Tools Industrial Corp. Date: Unknown.

9780 Palm Nailer. <www.surebonder.com>. FPC Corporation. Date: Unknown.

Porter-Cable Palm Nailer Kit PN650. <www.epinions.com>. Date: 2003.

Bostitch PN100K Impact Nailer Kit <www.amazon.com>. Date: 2002.

Bostitch PN100K Impact Nailer. Stanley Bostitch. Date: 2004. (1 page diagram).

Bostitch PN100K Impact Nailer. Stanley Bostitch. Date: 2004. (2 photographs).

Crain Tool No. 558 Staple Set Tool. Crain Tools. <www.craintools.com>. Date: Jan. 2009 or earlier. (Internet information and 3 photographs).

MPN50 Nailer. Chongquing Hybest Tools Group Co., Ltd. Date: Unknown.

Craftsman 11818 Nextec 12-volt Lithium Ion Cordless Hammerhead Auto Hammer. <www.sears.com>. Sears Roebuck & Co. Date: 2007.

* cited by examiner

TAPERED GUIDE BUSHING FOR RECIPROCATING DRIVER AND TOOL INCORPORATING SAME

CROSS-REFERENCE TO RELATED APPLICATIONS

This application claims the benefit of U.S. provisional patent application Ser. No. 61/081,062, filed Jul. 16, 2008 by the present inventor.

BACKGROUND

1. Field

This application relates to a compact, reciprocating, electrically or pneumatically operated impact tool, and specifically to an improved nail guide bushing mechanism for palm nailers.

2. Prior Art

The previously known mechanisms for power driving have been of substantial size and weight and dimensionally unsuited for operation in confined areas. Such mechanisms also have primarily incorporated the principle of a single stroke operation, controllable at the desire or will of an operator, and have not normally been adapted for use where relatively short repetitive strokes of a tool or operating mechanism are desirable.

Compact reciprocating impact tools, which are electrically or pneumatically operated (Hammerhead auto hammer, palm nailer) have overcome the drawbacks in these previously mentioned mechanisms, and provide a device of relatively small dimension. Such tools are lightweight, comfortably usable in confined areas by an operator, and substantially reduce problems of manipulation and fatigue by the user.

These compact impact tools can be used in compact areas, but have neglected to address the issue of placing nails which require the impact to be located in compact places, such as the positioning of a nail within a recess that is not accessible by the prior art devices. In FIG. 12 the prior art guide bushing or rod has maintained a large face compared to the size of the nail head which it guides. Therefore, if a nail must be located in a narrow channel or in the inside corner of a tongue and groove floor, the impact tool cannot nail in confined nail placement areas.

Developers of prior art products failed to address this problem because a mini palm nailer, for example, is designed for a broad use, up to 16d nails. Therefore the guide bushing must have a bore in the end large enough to receive the head of a 16d nail plus the perimeter of the bushing including the guide bushing material thickness plus room for a magnetic holder leaving a large diameter at the end of the guide bushing. Prior-art nailers are generally designed for nail placement on flat surfaces.

SUMMARY

A guide bushing with a conical or tapered distal end which can be round, flat, or tapered at the distal end of the guide bushing. The guide bushing is modified for a variety of fasteners. A second guide bushing can be used for additional support. The guide bushing has a peripheral collar and is slide mounted in a guide bushing securing collar. The guide bushing collar (a type of shoulder ) is adapted for engagement with a circular abutment formed in the interior bore of the securing collar to limit outward guide bushing movement when mount on a fastener-driving tool. A driver rod can be modified for a variety of fasteners.

One embodiment of this tool is FIG. 13 a mini palm nailer with a driver rod slightly larger than a finish nail. The guide bushing is tapered with a bore to both guide the driver rod and the fastener. The taper allows the fastener to be driven in the tongue of a floor board while operating close to a wall as illustrated in FIG. 15.

DRAWINGS

DETAILED DESCRIPTION

Figure 5:
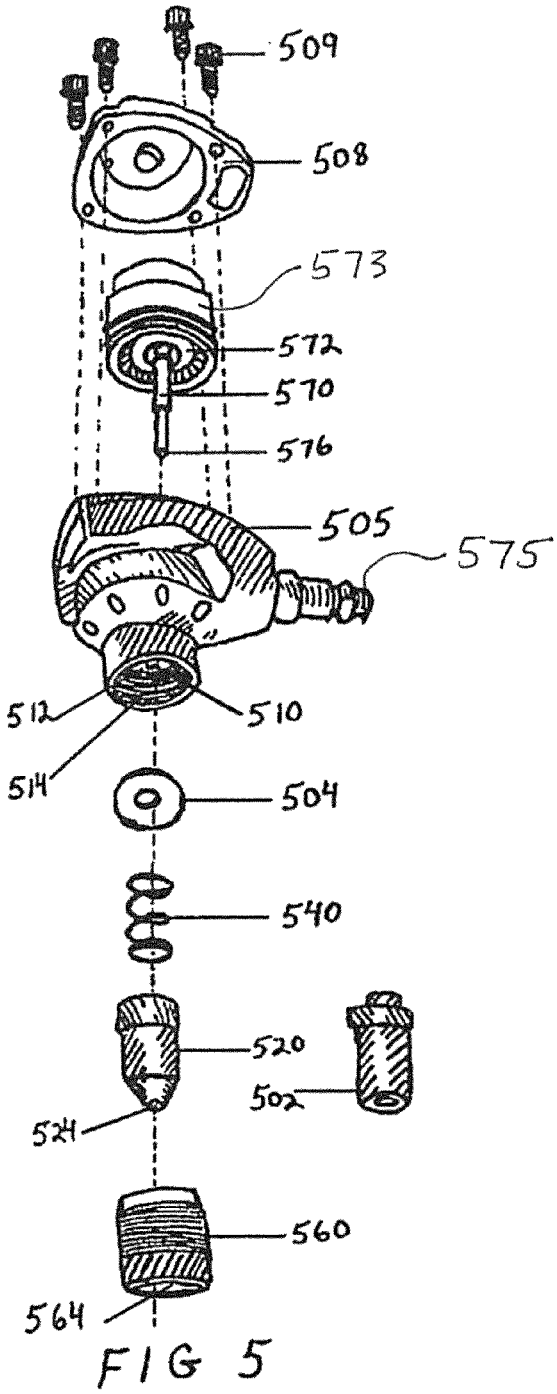
FIG. 5 is an exploded perspective view of a palm nailer incorporating a tapered guide bushing and stepped driver according to a further embodiment of the invention.
Figure 5A:
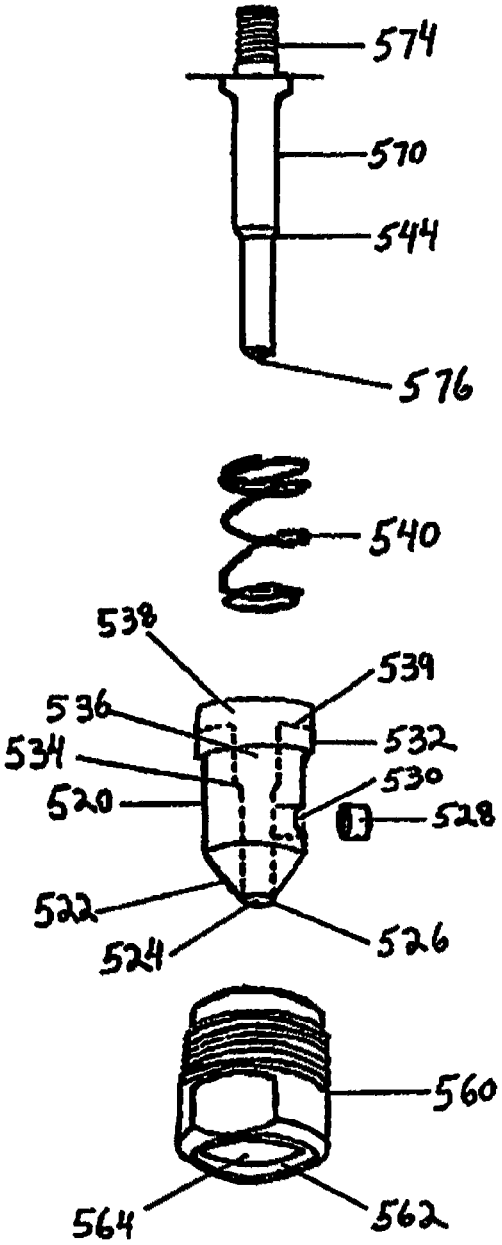
FIG. 5A is an enlarged exploded perspective view of a tapered guide bushing assembly of FIG. 5.

First Embodiment—FIGS. 5A and 5

FIGS. 5 and 5A show a guide bushing 520 having a taper 522 to a sharp edge tip 526. A magnet 528 is adhered in a perpendicular bore 530 to a guide bushing bore 524. The guide bushing 520 has a stepped center bore 536 forming a shoulder 534 which is congruent in shape to a driver rod 570 with a shoulder 544. The driver rod 570 is guided by the guide bushing bore 524. The guide bushing 520 has a stepped bore 538 forming a spring seat 539. The guide bushing 520 has a peripheral collar 532 (a type of shoulder). Guide bushing 520 is slide mounted into a removable guide bushing securing collar 560. The collar 532 is adapted for engagement with a circular abutment 562 formed in the interior bore 564 of the securing collar 560.

Referring again to FIGS. 5 and 5A, driver rod 570 is threaded into a piston 572. FIG. 5 shows the piston 572 attached to the driver rod 570 showing a removable assembly 570 and 572. Piston 572 is seated in a cylinder 573 which permits piston 572 to repeatedly reciprocate back and forth in short strokes to provide an intermittent force delivered by driver 570 to a fastener (e.g., nail 1408 or cleat 1154) in guide bushing bore 524 when pressurized air is supplied to the air inlet 575 from a pressurized air source and the tool is activated as is known in the art. Cylinder 573 including piston 570 seated therein is encased in both a lower housing 505 and upper housing 508 secured together with aligned screws 509. Referring further to FIGS. 5 and 5A, driver end 576 is inserted through a body bore 510, a spacing washer 504, the spring 540, the guide sleeve 520, the guide bushing bore 526, and the securing collar bore 560. A prior art guide bushing 502 is shown.

These specifics are what I presently prefer for this embodiment and I presently contemplate that the guide bushing 520 of the embodiment of FIG. 5A may have a circular cross section with a circular bore 524 and be made of 4041 steel. However this embodiment can have different cross sections, such as oval, triangular, rectangular, square, hexagonal, etc. and different shaped guide bushing with varying bores, with drive rods of varying sizes and shape for a variety of fasteners. These can be made of materials such as austenitic steel, high carbon steel, magnetized steel, titanium, polycarbonates, etc. With the embodiment of FIG. 5A and others it will be important to provide a choice of driver rod assemblies, an assortment of guide bushings, springs, securing collars and tools to disassemble and assemble.

Operation

FIG. 5A shows an exploded perspective view of one embodiment of a tapered guide bushing assembly including a driver rod 570 which is positioned with the guide bushing 520. Guide bushing 520 is retractable upon contact with the fastener-receiving member (i.e., a hardwood floor board 1502 or other article) into which the fastener is being driven. The guide bushing 520 has a taper 522 which intersects a guide bushing bore 524 at a sharp edge tip 526. A magnet 528, which holds a fastener, is adhered in a bore 530 perpendicular to the guide bore 524. The guide bore 524 has a stepped bore 536 which guides a driver rod 570 which also has a stepped shoulder 544 to match the bore shoulder 534.

As illustrated in FIG. 5, the lower assembly consists of a removable guide bushing securing collar 560 which joins the guide bushing 520 with a mating guide bushing peripheral collar 532. Guide bushing 520 is slide mounted into the securing collar 560. The collar 532 is adapted for engagement with a circular abutment 562 formed in a interior bore 564 of the securing collar 560. The securing collar 560 secures the tapered guide bushing assembly illustrated in FIG. 5A by threading into the body threads 514 illustrated in FIG. 5. The driver rod 570 is threaded into a piston 572 forming a removable driver rod assembly 570 and 572. The piston 572 is seated in a cylinder 573 which is encased in both a lower housing 505 and upper housing 508 secured together with aligned screws 509 as is known in the art. Piston 572 repeatedly reciprocates back and forth in short strokes in cylinder 573 to provide an intermittent force delivered by rod 570 to a fastener (e.g., nail 1408 or cleat 1154) in guide bushing 520 when pressurized air enters air inlet 575 from pressurized air source and the tool is activated. The intermittent force is used to drive the fastener supported by an inventive guide bushing 520 essentially fully into an article such as the tongue-and-grove flooring board 1502 illustrated in FIG. 15.

A driver end 576 is inserted through body bore 510, a spacing washer 504, the spring 540, the guide bushing bore 524, and the securing collar bore 564. As illustrated in FIG. 5A, the top of the guide bushing 520 has a spring seat bore 538, forming a spring seat shoulder 539 on which a spring 540 is mounted. Spring 540 contacts a spacing washer 504. Washer 504 abuts body 512 as illustrated in the example of FIG. 5. The spring 540 forces the guide bushing 520 outward. The bushing bore 524 supports a fastener positioned therein.

As the operator applies force activating impact by the driver 570, the spring 540 allows the guide bushing 520 to retract as the bushing 520 makes contact with the surface of the article into which the fastener is being driven. The guide bushing 520 guides and supports the fastener as it is driven into the surface of the article.

As illustrated in FIG. 5A, the guide bushing 520 has a peripheral collar 532 and is slide mounted in the guide bushing securing collar 560. The collar 532 is adapted for engagement with a circular abutment 562 formed in the interior bore 564 of the securing collar 560 at the lower end of an enlarged diameter portion of the bore 564. The collar 560 and guide bushing 520 interact. The collar 560 serves as a guide for maintaining positive alignment of the driver 570 driving end 576 with a head of a fastener in the guide bushing 520 during impact, while also providing a positive limit stop which limits guide bushing 520 movement away from the lower housing 508.

Figure 15:
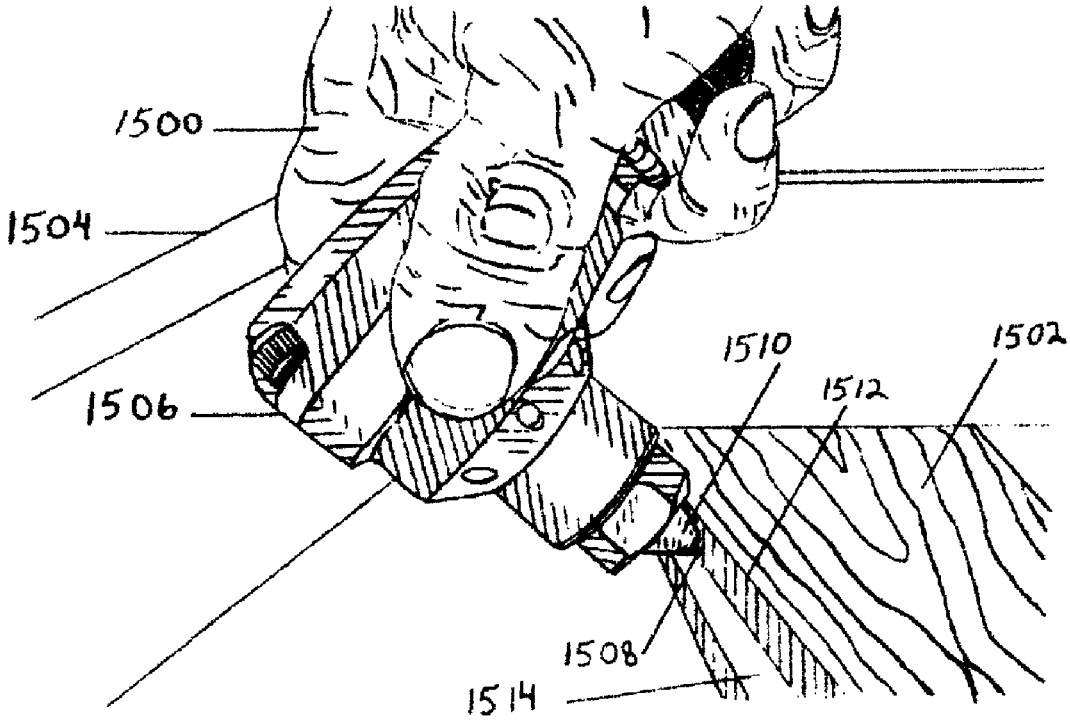
FIG. 15 is a perspective view of a palm nailer according to the invention positioned to drive a nail in a confined space and angled location which is able to achieve the proper results of driving the nail essentially fully into the article.

Application of force between a fastener (e.g. a nail 1408 or a cleat 1154) to be driven and the driver end 576 activates rapid reciprocating driver 570 impact until the fastener reaches its predetermined depth which deactivates impact. The depth to which the fastener (e.g., nail 1408 or cleat 1154) is driven is controlled by use of spacing washers 504 as shown in the example of FIG. 5. Use of relatively more spacing washers 504 or fewer spacing washers 504 allows the user to determine the desired depth by which to set the fastener. This embodiment enables the operator to drive a variety of fasteners in confined fastener-placement as illustrated in FIG. 15 in addition to normal fastener-placement areas.

Figure 8:
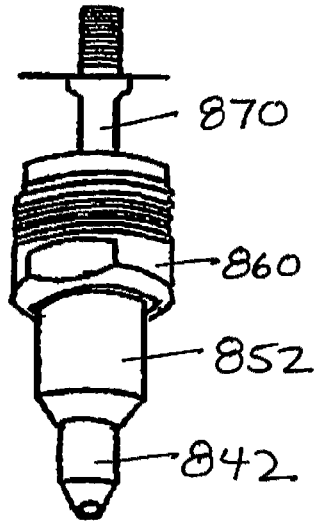
FIG. 8 is a perspective view of a further guide bushing assembly embodiment including plural cooperating guide bushings.
Figure 8A:
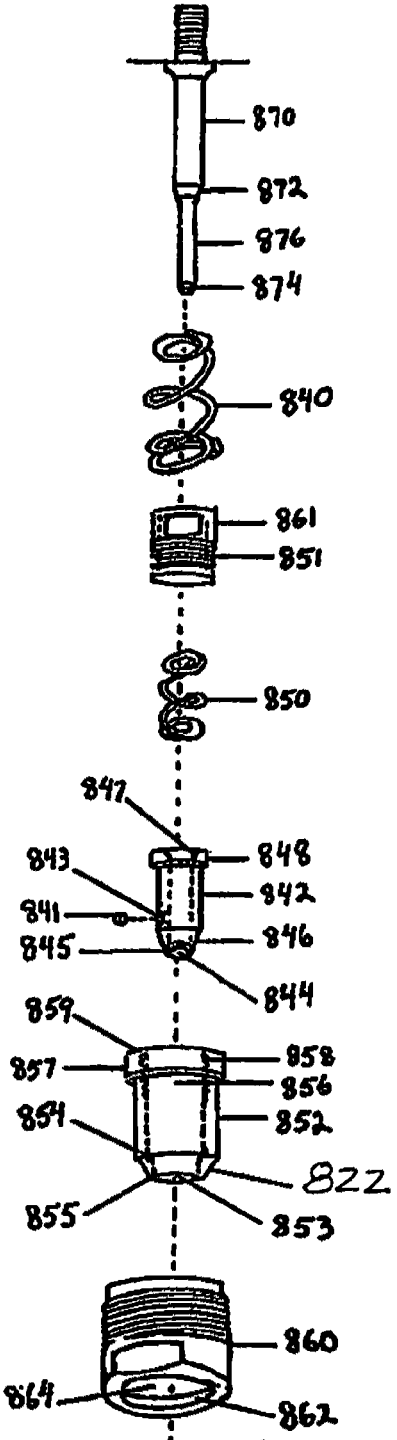
FIG. 8A is an exploded perspective view of the guide bushing assembly embodiment of FIG. 8.

FIG. 8A is an exploded perspective view of a guide bushing assembly including plural cooperating guide bushings with a stepped driver according to the further embodiment of the invention of FIG. 8.

Referring to FIG. 8 and FIG. 8A, there is shown a guide bushing assembly which consists of a guide bushing 842 in which driver rod 870 is positioned and a guide bushing 852 in which guide bushing 843 is positioned in a telescoping relationship. The guide bushing 842 retracts upon contact with the receiving member (e.g., the flooring board 1402,1502 or other article) into which the fastener (e.g., nail 1408 or cleat 1154) is being driven, to facilitate continued driving of the fastener to its proper depth. The guide bushing 842 includes a taper 846 ending in an apse 845 (i.e., a rounded end) which intersects a guide bushing bore 844.

A magnet 841 is adhered in a bore 843 perpendicular to bore 844 and which intersects the guide bore 844. The guide bushing 842 has a peripheral collar 848 (a type of shoulder) and is slide mounted into a larger first guide bushing 852 from the top. The peripheral collar 848 is adapted for engagement with a circular abutment 854 formed in a bore 856 of the guide bushing 852.

A spring 850 is inserted into the bushing bore 856 on top of the guide bushing 842. A threaded bore sleeve 851 is inserted into a threaded bore 858 of guide bushing 852. Interaction between the sleeve 851 and guide bushing 842 serves as a guide for maintaining positive alignment of a driving end 874 of driver 870 with a head of a fastener (e.g., nail 1408 or cleat 1154) during impacting, while also providing positive limit stops.

The guide bushing 842 has an interior peripheral collar 847 congruent (i.e.,axially aligned) with a driver rod 870 and a driver rod shoulder 872. The guide bushing 852 has a taper 822 which intersects the guide bore 853 at a sharp edged tip 855. The guide bushing 852 has a peripheral collar 857 (a type of shoulder). The guide bushing 852 is slide mounted in a securing collar 860. The collar 857 is adapted for engagement with a circular abutment 862 formed in a bore 864 of the securing collar 860. Cooperative interaction between the guide bushings 842, 852 and between guide bushing 852 and collar 860 serves as a guide for maintaining positive alignment of the driving end 874 with a head of a fastener (e.g., nail 1408 or cleat 1154) during driving, while also providing positive limit stops.

A spring 840 has one end which contacts housing body 505 in the same manner as spring 540 illustrated in FIG. 5. Spring 840 has a second end which is fitted over neck 861 and contacts bushing shoulder 859. Both springs 850 and 840 act independently and allow both guide bushings 842 and 852 to fully extend allowing the guide bushing 852 to support the guide bushing 842 which supports the fastener (e.g., nail 1408 or cleat 1154). Both the guide bushings 842 and 852 retract independently as the operator applies force while driving fasteners. The driver rod 870 narrows at the shoulder 872 to a smaller rod dimension 876 with the driver end 874.

When force is applied between a fastener to be driven and the driver end 874 activating rapid reciprocating driver rod 870 impact until the fastener reaches its predetermined depth which deactivates impact. The depth to which the fastener (e.g., nail 1408 or cleat 1154) is driven is controlled by use of spacing washers 504 in the same manner as shown in the example of FIG. 5. Use of relatively more spacing washers 504 or fewer spacing washers 504 allows the user to determine the desired depth to which the fastener is set into the article (e.g., hardwood flooring board 1502). This embodiment enables the operator to drive fasteners in confined nail placement areas as illustrated in FIG. 15 in addition to normal fastener placement areas.

Figure 8B:
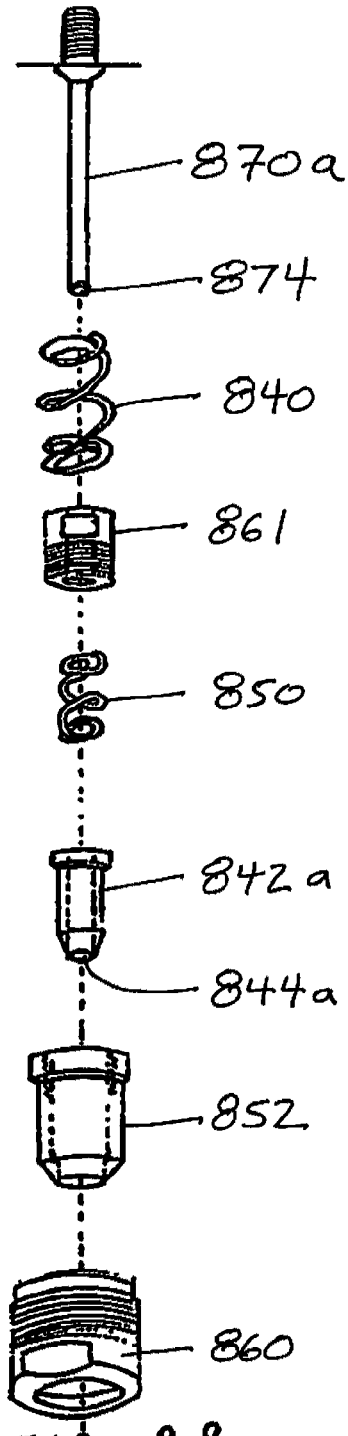
FIG. 8B is an exploded perspective view of a further guide bushing assembly embodiment including plural cooperating guide bushings.

FIG. 8B illustrates a further embodiment which incorporates the same parts as the embodiment of FIG. 8A except that driver rod 870*a* and guide bushing 842*a* differ from driver rod 870 and guide bushing 842. As illustrated in FIG. 8B, driver rod 870*a* is a straight rod which lacks shoulder 872 of stepped driver rod 870 of FIG. 8A and has a width (i.e., a cross-sectional area) greater than the width of portion 876 of rod 870. Also as illustrated in FIG. 8B, guide bushing 842*a* has a straight bore 844*a* which is sized to accommodate driver rod 870*a* and guide bushing 842*a* lacks the interior peripheral collar 847 of guide bushing 842. The examples of FIGS. 8A and 8B illustrate that different driver rods and guide bushings can be implemented and interchanged.

Figure 1:
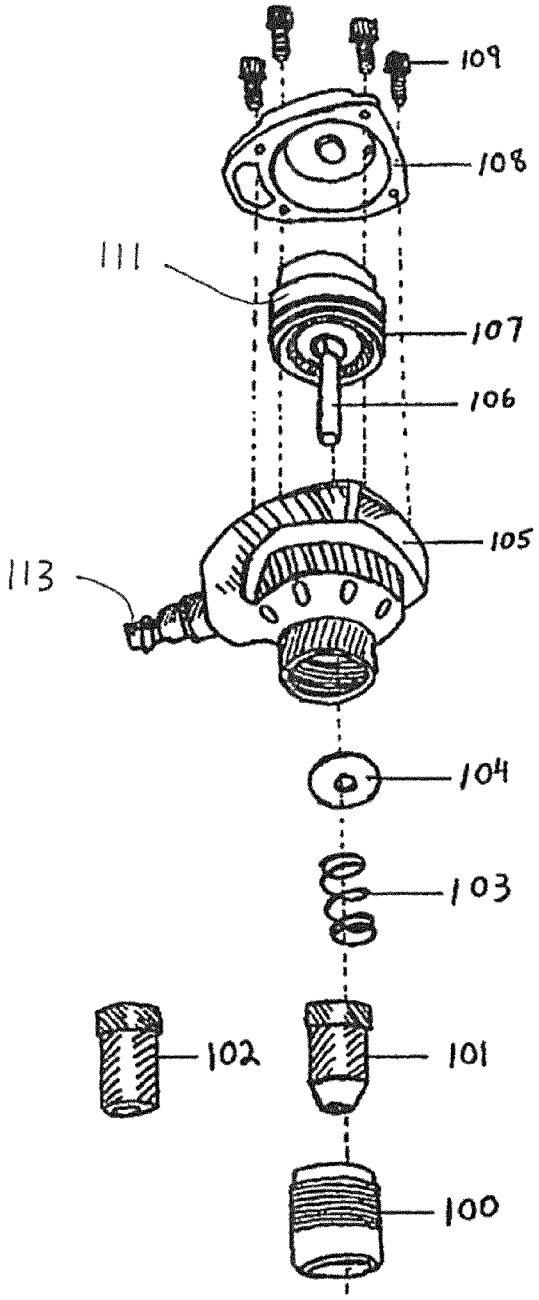
FIG. 1 is an exploded perspective view of a palm nailer incorporating a tapered guide bushing according to the invention.

This embodiment consists of a securing collar 100, a tapered guide bushing 101, prior art straight guide bushing 102, a spring 103, a spacing washer 104, a lower housing body 105, a driver 106, a piston 107, a cylinder 111, an upper housing body 108, a pressurized air inlet 113 which receives pressurized air from a pressurized air source and a assembly screw set 109. In the example of FIG. 1, piston 107 is seated in cylinder 111 as is known in the art. Cylinder 111 is mounted within upper and lower housing bodies 105, 108. Piston 107 repeatedly reciprocates back and forth in short strokes in cylinder 111 to provide an intermittent force delivered by driver 106 to a fastener (e.g., nail 1408 or cleat 1154) in guide bushing 101 when pressurized air enters air inlet 113 from a pressurized air source and the tool is activated. The intermittent force is used to drive the fastener (e.g., a nail 1408 or a cleat 1154) supported by an inventive guide bushing 101 essentially fully into an article such as the tongue-and-groove flooring board 1502 illustrated in FIG. 15.

Figure 2:
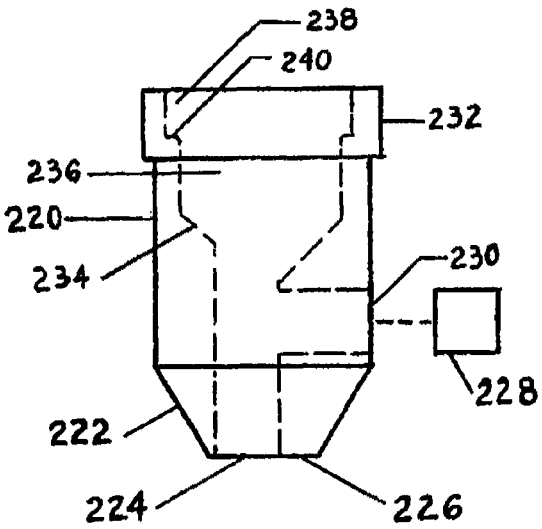
FIG. 2 is an enlarged perspective view of the tapered guide bushing of FIG. 1.

FIG. 2 is an enlarged perspective view of a tapered guide bushing 220 according to a further embodiment of the invention.

Guide bushing 220 is provided with a taper 222 to a flat tip 226. A magnet 228 is adhered in a bore 230 perpendicular to guide bushing 220 which intersects an off centered bushing bore 224. The guide bushing 220 has a stepped centered shoulder bore 236, forming a shoulder 234, and a stepped bore 238 forming a spring seat 240. The guide bushing 220 has an upper peripheral collar 232 (a type of shoulder).

Figure 3:
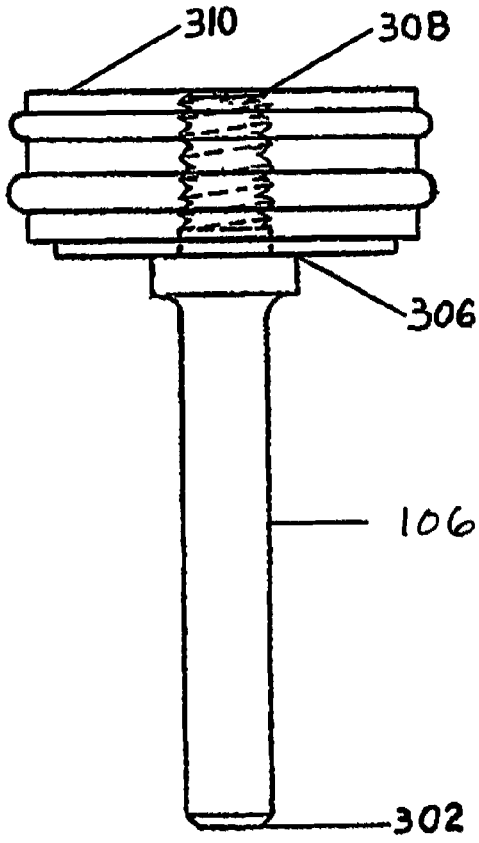
FIG. 3 is an enlarged perspective view of a driver of the palm nailer of FIG. 1.

FIG. 3 is an enlarged perspective view of a driver 106 of the palm nailer of FIG. 1.

The driver 106 consists of a straight driver 300, a driver end 302, an upper shoulder 306, and a threaded end 308. The treaded end 308 is connected to a piston 310. Piston 310 is reciprocatingly driven within cylinder 111 by pressurized air when the tool is activated.

Figure 4:
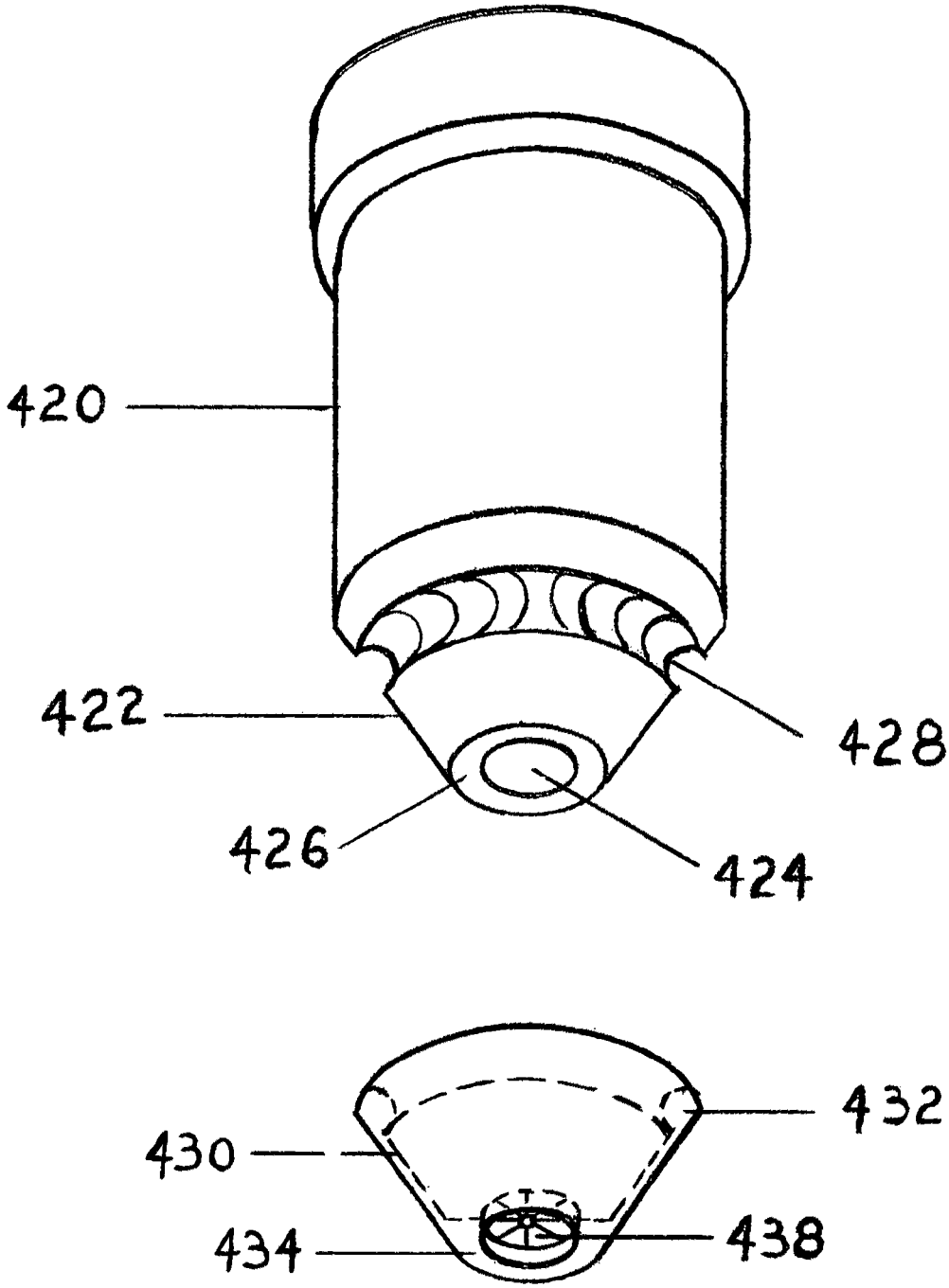
FIG. 4 is an enlarged view of the tip of the tapered guide bushing which could be implemented in the embodiments of FIGS. 1 and 5, showing a circumferential groove for receiving a cushioned tip/boot.

FIG. 4 is an enlarged view of the tip of a tapered guide bushing 420 (showing a circumferential groove for receiving a cushioned tip/boot) according to a further embodiment of the invention.

FIG. 4 shows a guide bushing 420 with a taper 422 to a flat tip 426 joining a guide bore 424. The taper has an o-ring groove 428 cut in the upper circumference of the taper 422 to hold a protective cushioned boot 430 by an upper o-ring band 432. The boot 430 fits the flat tip 426 with a flat sided o-ring sole 434. The o-ring sole 434 does not protrude within the bore 424. The sole 434 provides the guide bushing tip with a non-marring surface. The o-ring sole 434 may include a flexible nail centering retainer 438 which allows enough room for a finish nail to be set through the retainer 438 and into the guide bushing bore 424 for driving.

Figure 6:
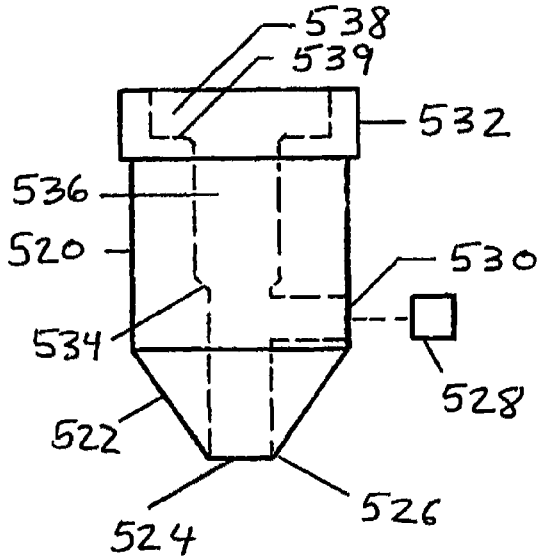
FIG. 6 is an enlarged perspective view of the tapered guide bushing of FIGS. 5 and 5A.

FIG. 6 is a further enlarged perspective view of the tapered guide bushing 520 of FIGS. 5 and 5A.

FIG. 6 shows guide bushing 520 with a taper 522 to a sharp edge tip 526. A magnet 528 is adhered in a bore 530 which is perpendicular to bore 524 and intersects guide bushing bore 524. The guide bushing 520 has a stepped center bore 536 forming a shoulder 534. The guide bushing 520 has a stepped bore 538 forming a spring seat 539 . The guide bushing 520 has an upper peripheral collar 532.

Figure 7:
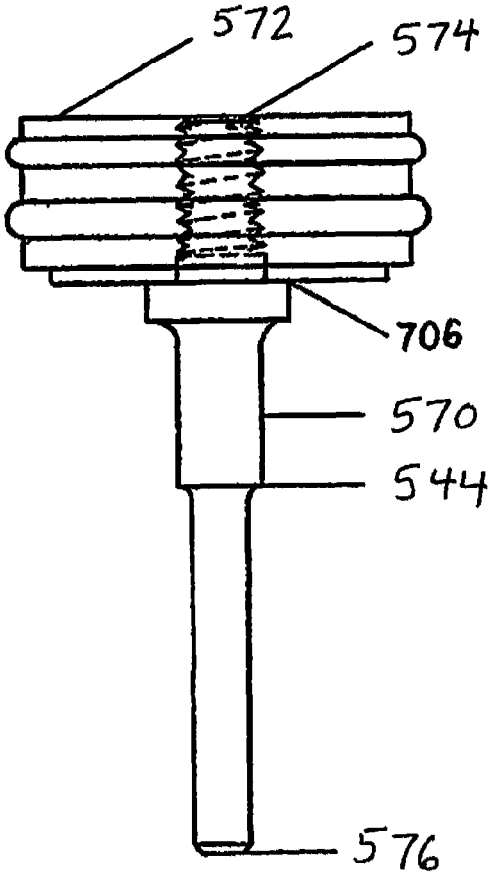
FIG. 7 is an enlarged perspective view of a stepped driver of the palm nailer of FIG. 5.

FIG. 7 is an enlarged perspective view of a stepped driver 570 of the palm nailer of FIG. 5.

FIG. 7 shows a stepped driver 570 which consists of a driving end 576, a mid shoulder 544, an upper shoulder 706, and the threaded end 574. The threaded end 574 is connected to a piston 572. Piston 572 is reciprocatingly driven back and forth within cylinder 573 by pressurized air when the tool is activated.

Figure 9:
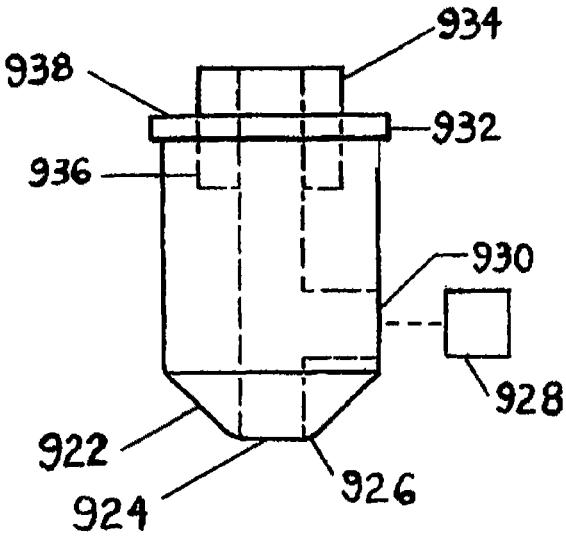
FIG. 9 is an enlarged perspective view of a tapered guide bushing (with an apse tip, that is a rounded tip) according to a further embodiment of the invention.

FIG. 9 is an enlarged perspective view of the tapered guide bushing (with an apse tip, that is a rounded tip) according to a further embodiment of the invention.

FIG. 9 shows a guide bushing 920 with a taper 922 to an apse tip 926. A magnet 928 is adhered in a bore 930 which is perpendicular with and intersects a guide bushing straight bore 924. The top of the guide bushing 920 has a guide sleeve 934 inserted into a bore 936 on a flat top spring seat 938. The guide bushing 920 has an upper peripheral collar 932 (a type of shoulder).

Figure 10:
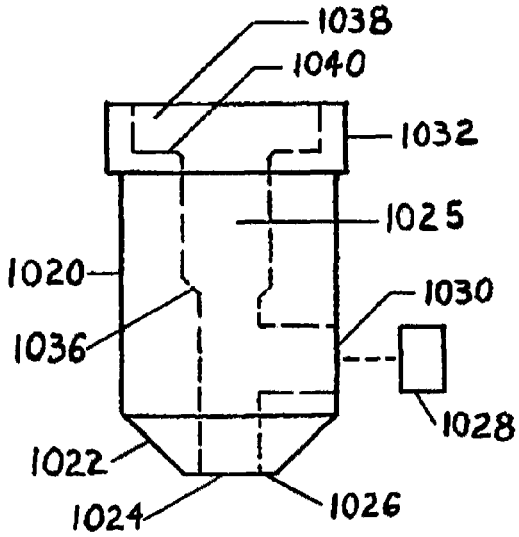
FIG. 10 is an enlarged perspective view of a tapered guide bushing (with flat tip) according to a further embodiment of the invention.

FIG. 10 illustrates a guide bushing 1020 with a taper 1022 to a flat tip 1026. A magnet 1028 is adhered in a bore 1030 perpendicular to a guide bushing bore 1024. A shoulder bore 1025 forms a shoulder 1036 in the guide bore 1024. The top of the guide bushing 1020 has a stepped bore 1038 forming a spring seat 1040. The upper edge of bushing 1020 has a peripheral collar 1032 (a type of shoulder).

Figure 11:
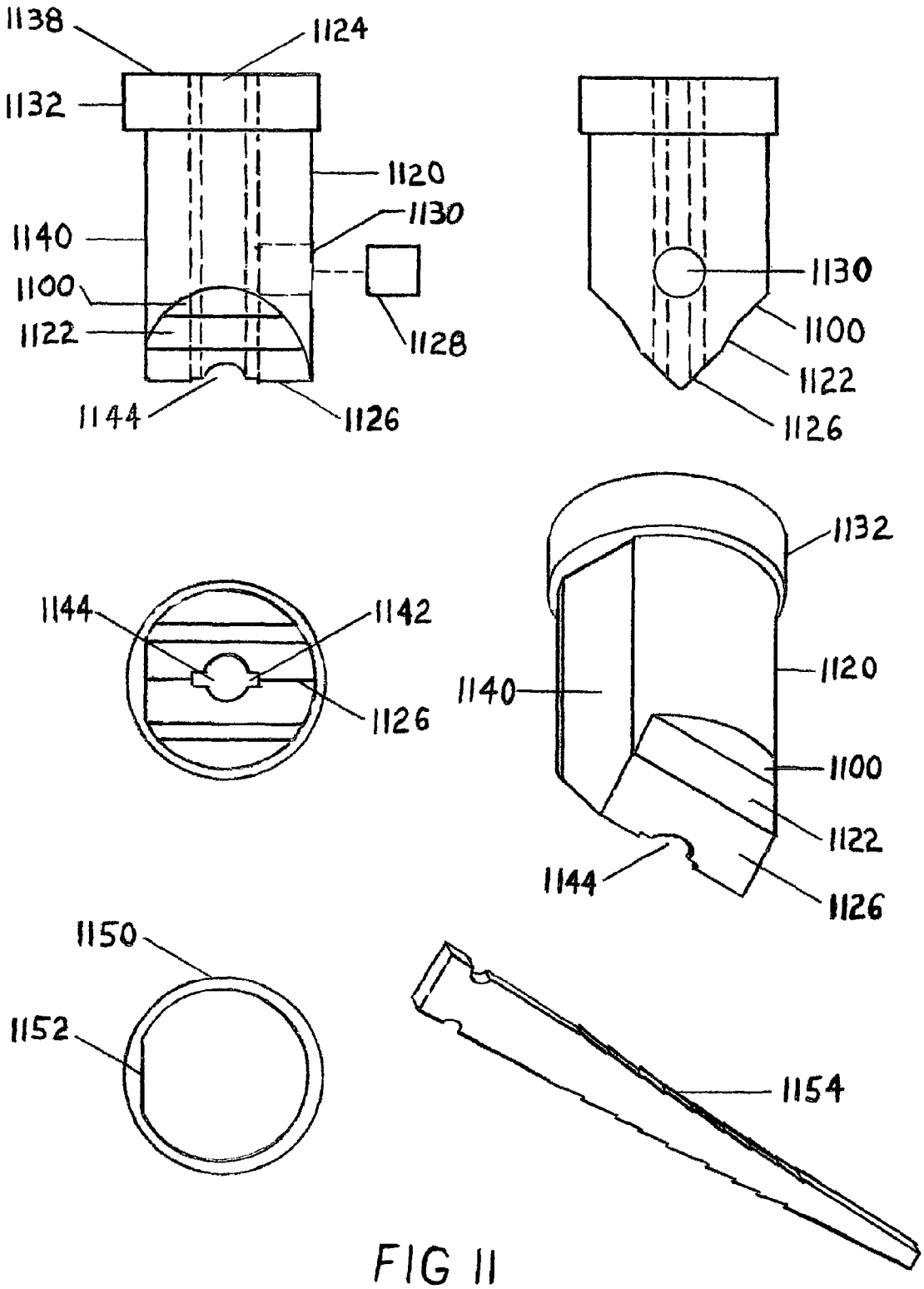
FIG. 11 is an enlarged perspective view of a tapered guide bushing (with a wedged tip) according to a further embodiment of the invention.

FIG. 11 shows a tapered guide bushing 1120 with a main taper 1122 on two sides leaving a shoulder 1100 on each side of the circumference. The taper 1122 joins a beveled tip 1126. The tapered guide bushing 1120 has a flat directional guide 1140 on the outside surface of the cylinder wall, which matches a directional guide washer 1150 with a congruent flat portion 1152. A magnet 1128 is adhered in a perpendicular bore 1130 which intersects a guide bushing straight bore 1124. The guide bushing bore 1124 has a broached bore 1142 including a pair of rectangular portions for orienting a flat fastener (e.g., cleat 1154) for driving leaving a Saturn shaped guide bore 1144. The upper edge has a peripheral collar 1132 (a type of shoulder). The top of the guide bushing 1120 has a flat spring seat 1138. This embodiment is used for driving rectangular floor cleats 1154.

Figure 12:
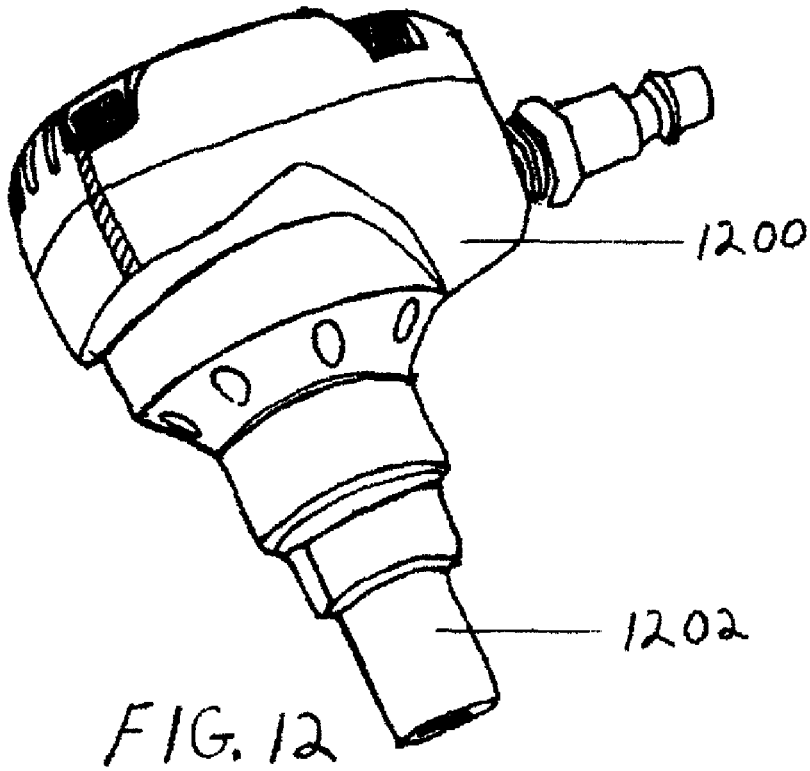
FIG. 12 is a perspective view of a prior art palm nailer.

FIG. 12 is a perspective view of a prior art palm nailer. FIG. 12 shows a prior art palm nailer 1200 with a standard guide bushing 1202.

Figure 13:
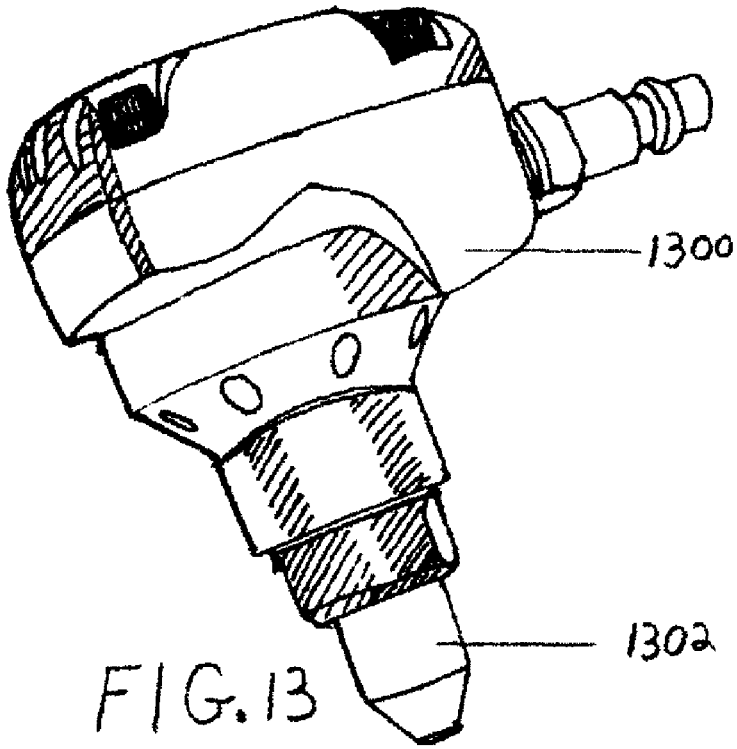
FIG. 13 is an enlarged perspective view of a palm nailer with a tapered guide bushing according to a further embodiment of the invention.

FIG. 13 is an enlarged perspective view of a palm nailer with a tapered guide bushing according to a further embodiment of the invention. FIG. 13 shows a palm nailer 1300 with a tapered guide bushing 1302 which is able to be positioned into compact areas for nail placement.

Figure 14:
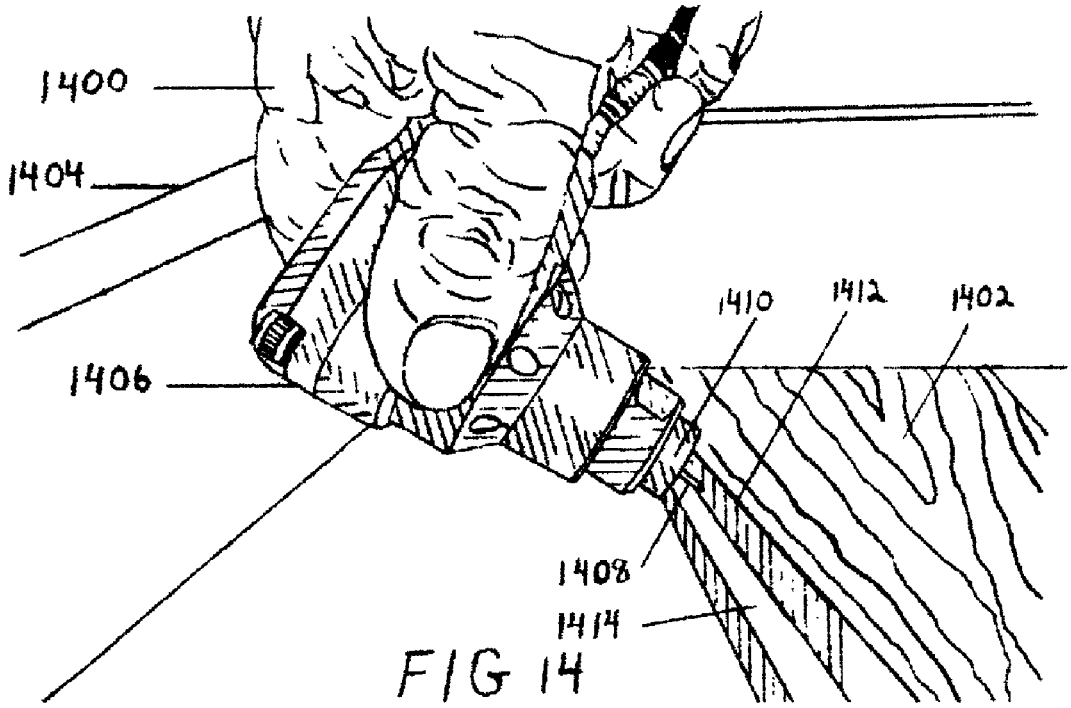
FIG. 14 is a perspective view of a prior art palm nailer positioned to drive a nail in a confined space and angled location and is unable to achieve the proper result of driving the nail essentially fully into the article.

FIG. 14 is a perspective view of a prior art palm nailer positioned to drive a nail in a confined space or angled location and is unable to achieve the proper result. FIG. 14 shows an operator 1400 installing a tongue and a groove pre-finished hardwood floor 1402 in a confined space near a wall 1404, with a prior art mini palm nailer 1406. Most mini palm nailers 1406 are unable to drive a finish nail 1408 successfully. A bent nail can damage the floor finish. Mini palm nailers 1406 are set up for common nails up to 16d nails. If the mini palm nailer 1406 is able to drive the finish nail 1408 the driver is unable to drive much father than a large flat tip guide bushing 1410. The guide bushing 1410 which is resting on a finished floor edge 1412 and on a floor tongue 1414 will not allow the nail 1408 to be set properly. If the nail bending does not damage the floor 1402, the guide bushing 1410 will damage finished floor edge 1412.

FIG.15 is a perspective view of a palm nailer according to the present invention positioned to drive a nail in a confined space or angled location. FIG. 15 shows an operator 1500 installing a tongue and groove pre-finished hardwood floor 1502 in a confined space near a wall 1504 with a mini palm nailer 1506 according to this embodiment. This embodiment of the palm nailer 1506 is able to drive the finish nail 1508 successfully. The Palm nailer is designed with a guide bushing 1510 that supports the finish nail 1508 and sets the nail 1508 properly. The palm nailer 1506 is able to rest on top of the tongue 1514 and beneath the floor edge 1512 and move freely to adjust the nailing angle without damaging the floor edge 1512. This embodiment will save many hours on a hard wood flooring installations and other types of work.

I claim:

1. A guide bushing for a fastener-driving tool having a housing and a guide bushing securing collar, comprising:

a body which moves axially within the collar when the guide bushing is secured to the tool by the collar, the body having an external surface, a width, a proximal end, a distal end, and a central portion between the ends, said body further including at least one surface defining a fastener-receiving guide aperture extending through the body from the proximal end to the distal end, said at least one surface being provided for keeping a fastener when received in the aperture in position for fastener driving by intermittent force delivered by a driver in the aperture, said body retracting axially toward the housing by contact with an article during the fastener driving when the guide bushing is secured to the tool by the collar;

a shoulder extending outward from the body adjacent the body proximal end which cooperates with the collar to limit axial movement of the body away from the housing when the guide bushing is secured to the tool by the collar; and a taper in the body external surface from the central portion to the distal end adjacent the aperture, said taper narrowing the distal end sufficiently to fit within a portion of the article defining a space narrower than the body width so that the at least one surface of the aperture keeps the fastener in position to receive the intermittent force delivered by the driver during the fastener driving until the distal end is within the space and the fastener is essentially fully driven into the article.

2. The guide bushing according to claim 1, wherein the aperture comprises a first aperture portion extending from the proximal end of the body having a first cross-sectional area and a second aperture portion with a second cross-sectional area less than that of the first cross sectional area that extends from the first aperture portion to the distal end of the body.

3. The guide bushing according to claim 1, wherein the aperture comprises a rectangular portion for orienting a flat fastener for driving.

4. The guide bushing according to claim 1, further comprising a protective cover overlying at least the distal end of the taper in the body external surface, the protective cover having an aperture through which a fastener may be received into the fastener- receiving guide aperture.

5. The guide bushing according to claim 4, wherein the body external surface includes a groove formed therein transverse to a body axis and the protective cover includes a rib removably received in the groove to secure the protective cover to the body.

6. A fastener-driving tool comprising:

a housing;

an intermittent-force-generating apparatus in the housing;

a driver having a fastener-driving end which delivers an intermittent force from the intermittent-force-generating apparatus;

a biasing device;

a guide bushing biased away from the housing by the biasing device, the guide bushing including:

a body having an external surface, a width, a proximal end, a distal end and a central portion between the ends, said body further including at least one surface defining a fastener-receiving guide aperture extending through the body from the proximal end to the distal end, the fastener-driving end being positioned in the aperture to commence fastener driving and the at least one surface keeping a fastener, when received in the aperture, in position to receive the intermittent force delivered by the fastener-driving end;

a shoulder extending outward from the body adjacent the body proximal end; and a taper in the body external surface from the central portion to the distal end adjacent the aperture, said taper narrowing the distal end sufficiently to fit within a portion of an article defining a space narrower than the body width so that the at least one surface keeps the fastener in position to receive the intermittent force delivered by the fastener-driving end until the distal end is within the space and the fastener is essentially fully driven into the article; and a collar securing the guide bushing with respect to the housing for axial movement within the collar, the collar and shoulder limiting guide bushing axial movement away from the housing and the collar allowing the guide bushing to retract axially toward the housing against the biasing device so that the guide bushing distal end approaches the fastener-driving end during the fastener driving when the guide bushing distal end contacts the article and is positioned within the space and the housing and driver approach the article while the at least one surface keeps the fastener in position to receive the intermittent force delivered by the fastener-driving end thereby enabling the driver to essentially fully drive the fastener into the article.

7. The fastener-driving tool according to claim 6, wherein the guide bushing is removably attached to the housing by the collar.

8. The fastener-driving tool according to claim 6, wherein the aperture comprises a first aperture portion extending from the proximal end of the body having a first cross-sectional area and a second aperture portion with a second cross-sectional area less than that of the first cross sectional area that extends from the first portion to the distal end of the body.

9. The fastener-driving tool according to claim 8, further comprising the driver having a proximal portion and a distal portion and the fastener-driving end is the distal portion.

10. The fastener-driving tool according to claim 6, wherein the aperture comprises a rectangular portion for orienting a flat fastener for driving.

11. The fastener-driving tool according to claim 6, further comprising a protective cover overlying at least the distal end of the taper in the body external surface, the protective cover having an aperture through which a fastener may be received into the fastener-receiving guide.

12. The fastener-driving tool according to claim 11, wherein the body external surface includes a groove formed therein generally transverse to a body axis and the protective cover includes a rib removably received in the groove to secure the protective cover to the body.

13. The fastener-driving tool according to claim 12, wherein the cover further includes a proximal end including the rib and a distal end.

14. The fastener-driving tool according to claim 13 wherein the cover distal end further comprises a distal cushion.

15. The fastener-driving tool according to claim 6, wherein the guide bushing further comprises an aperture for receiving a magnet.

16. The fastener-driving tool according to claim 1, wherein the repeated intermittent force is delivered by a reciprocating driver.

17. The fastener-driving tool according to claim 6, wherein the tool is a palm nailer.

18. The fastener-driving tool according to claim 17, wherein the housing is compact and fits within a user's hand thereby enabling the tool to be used in close proximity with a vertical surface as the palm nailer approaches the vertical surface.

19. The fastener-driving tool according to claim 6 wherein the article portion defining the space is an inside corner of a tongue-and-groove flooring board and the taper narrows the distal end sufficiently to fit within the inside corner.

* * * * *